US005783531A

United States Patent [19]

Andrew et al.

[11] Patent Number: 5,783,531

[45] Date of Patent: Jul. 21, 1998

[54] MANUFACTURING METHOD FOR THE PRODUCTION OF POLYALPHAOLEFIN BASED SYNTHETIC GREASES (LAW500)

[75] Inventors: David Leslie Andrew, Arkona; Brian Leslie Slack, Sarnia, both of Canada

[73] Assignee: Exxon Research and Engineering Company, Florham Park, N.J.

[21] Appl. No.: 828,446

[22] Filed: Mar. 28, 1997

[51] Int. Cl.[6] ..... C10M 107/10; C10M 117/02; C10M 169/06

[52] U.S. Cl. ..... 508/510; 508/519; 508/528

[58] Field of Search ..... 508/510, 519, 508/528

[56] References Cited

U.S. PATENT DOCUMENTS

| | | | |
|---|---|---|---|
| 3,159,575 | 12/1964 | Criddle | 252/18 |
| 3,159,576 | 12/1964 | Criddle | 252/18 |
| 3,189,543 | 6/1965 | Criddle | 252/18 |
| 3,428,562 | 2/1969 | Crouch et al. | 252/42 |
| 3,681,242 | 8/1972 | Gilani et al. | 252/41 |
| 3,791,973 | 2/1974 | Gilani et al. | 252/41 |
| 4,597,881 | 7/1986 | Iseya et al. | 252/41 |
| 4,749,502 | 6/1988 | Alexander et al. | 252/35 |
| 5,133,888 | 7/1992 | Waynick | 508/189 |
| 5,282,986 | 2/1994 | Otake et al. | 252/18 |
| 5,364,544 | 11/1994 | Otake et al. | 508/148 |
| 5,641,731 | 6/1997 | Baumgart et al. | 508/183 |
| 5,668,092 | 9/1997 | Denton | 508/146 |

*Primary Examiner*—Jacqueline V. Howard
*Attorney, Agent, or Firm*—Joseph J. Allocca

[57] ABSTRACT

A method is disclosed for improving the thickener yield in soap thickened polyalphaolefin base oil greases comprising the steps of (a) producing a simple or complex soap thickener in a quantity of a first PAO of viscosity lower than that of the base oil component in the final grease composition to produce a thickened PAO and (b) adding to the thickened PAO a quantity of a second PAO of viscosity higher than that desired of the base oil component in the final grease composition sufficient to produce a final grease product having the desired base oil viscosity.

10 Claims, No Drawings

MANUFACTURING METHOD FOR THE PRODUCTION OF POLYALPHAOLEFIN BASED SYNTHETIC GREASES (LAW500)

BACKGROUND OF THE INVENTION

1. Field of the Invention

The present invention relates to simple and complex lithium soap thickened polyalphaolefin base oil greases and to a method for their production.

2. Description of the Related Art

The production of simple soap and complex soap/salt thickened greases and techniques for improving grease yields has long been practiced.

U.S. Pat. No. 3,159,575 teaches a process for improving grease yields of calcium soap/salt thickened greases by adding alkyl methacrylate-vinyl pyrrolidone copolymers to the grease. The base oil vehicle for such greases is described as mineral oil exemplified by naphthenic oil, paraffinic oil and mixed base oils derived from petroleum, including lubricating oils derived from coal products, etc.

U.S. Pat. No. 3,159,576 also teaches a method for improving grease yield of calcium soap/salt thickened greases by adding quaternary ammonium compounds to the grease in combination with the calcium soap/salt thickener.

U.S. Pat. No. 3,189,543 similarly teaches a method for improving grease yield of calcium soap/salt thickened greases by incorporating an oil soluble poly glycol substituted polymer into the grease.

In the preceding patents the greases were made by producing the calcium soap/salt thickener in a first portion of the final grease mineral base oil, adding the specified yield improving polymeric or quaternary ammonium compound additive then adding the balance of the mineral base oil to make the total of 100% of the specified mineral oil.

U.S. Pat. No. 3,681,242 teaches a two stage process for the production of high dropping point lithium soap/salt thickened grease. In the process the complex lithium soap/salt thickener is prepared in a first portion of base oil. This first portion of base oil corresponds to between 30 to 75% of the total amount of oil which will be present in the final grease. The fatty acids and dicarboxylic acids are heated with stirring in this first base oil portion to about 180°–210° F. Concentrated aqueous solution of lithium hydroxide is then slowly added and heated to 290°–310° F. to insure elimination of water. The temperatures is then further raised to at least 410° F. but no higher than 430° F. The balance of the base oil used to make the grease is then added to this mixture and the temperature is rapidly reduced to about 220° F. after which the mixture is reheated to about 350°–375° F. followed by immediate rapid cooling to a temperature in the range 220°–240° F. The mixture is held at this temperature for 8 to 16 hours then passed through a mill and cooled to room temperature.

Again, the oils used as the first and second (or balance) positions of oil employed are the same in each case.

U.S. Pat. No. 3,428,562 teaches a process for preparing a lithium grease composition containing synthetic oil as the sale lubricating oil component. The synthetic oils of interest is ester type synthetic lubricating oils. In this procedure fatty acid is saponified with aqueous lithium hydroxide at a temperature of 160°–200° F. after which 23–41 wt % of the synthetic ester type lube oil based on the total weight of oil in the finished grease is added. This is followed by heating at a rate of at least 0.7° F. per minute to a top temperature of between 380° to 450° F. while adding or adding 30 to 56 wt % of the same or different synthetic ester type lube oil. The mixture is held at the aforesaid temperature for from 0 to 30 minutes followed by cooling and the addition of any balance of synthetic ester oil needed to make 100% of the final desired oil content.

U.S. Pat. No. 4,749,502 is directed to a grease composition comprising an oil component having a major amount of a synthetic fluid having a viscosity of at least 50 cSt at 40° C. and a minor amount of a mineral oil having a pour point below −20° C. and a thickener. The synthetic fluid is preferably polyalphaolefin. The thickener comprises the simple lithium, calcium, aluminum and/or barium soaps of fatty acids such as stearic acid or 12-hydroxy stearic acid, or the complex calcium, lithium, barium and/or aluminum soaps/salts of the aforesaid fatty acids with lower molecular weight mono- or dibasic acids.

In U.S. Pat. No. 4,749,502 the viscosity of the mineral oil is lower than the viscosity of the synthetic fluid over the temperature range for which the use is contemplated. In producing the grease a blend of the aforesaid oils was used as the base stock.

U.S. Pat. No. 4,597,881 teaches a process for producing a lithium soap grease comprising the steps of adding a hydroxy fatty acid and dicarboxylic acid to a first base oil having an aniline point of 110° to 130° C. at a temperature of less than 100° C. with stirring to prepare a uniform dispersion of acids in the first base oil. Thereafter lithium hydroxide is added to the mixture and the mass is heated to a temperature of 195° to 210° C. The mass is cooled to a temperature not higher than about 160° C. at a rate of 20° to 80° C. per hour. Finally, a second base oil having an aniline point of from 130° to 140° C. is added to the mass so that the weight ratio of the first base oil to the second base oil is from 30:70 to 60:40 and the resulting mixture has a dynamic viscosity of 5 to 50 cSt @ 100° C. and an aniline point of from 125° to 135° C. The first and second base oils may each have a viscosity in the range 5 to 50 cSt at 100° C. In Examples 3 to 5 the first base oils employed had dynamic viscosities at 100° C. of 11.2 cSt, 11.4 cSt and 11.6 cSt while the corresponding second base oils employed last dynamic viscosities at 100° C. of 19.4 cSt, 19.2 cSt, and 19.2 cSt producing a final grease base oil blend having dynamic viscosities at 100° C. of 14.7 cSt, 14.7 cSt, and 14.8 cSt, respectively. In the case of these base oils, the components blended made the base oils were 500 Neutral oil, Bright stock and Naphthene mineral oil, no synthetic oils were used.

U.S. Pat. No. 5,364,544 are directed to grease for slide contacts based on synthetic oil which is polyalphaolefin. The PAO base oil consists of a synthetic PAO having a low viscosity of from 8 to 30 cSt at 40° C. and a synthetic PAO having a high viscosity of from more than 30 to about 470 cSt at 40° C. The base oil is apparently employed as a blend of such PAO's of different viscosities.

U.S. Pat. No. 5,133,888 teaches an engine bearing grease comprising a lithium soap thickener, a synthetic base oil blend of polyalphaolefins and extreme pressure anti wear additives and inhibitors comprising dithracarbamates, phosphates, and hydroxides. In the examples the base oil used was a per se blend of two PAO.

SUMMARY OF THE INVENTION

It has been discovered that improved yields of simple soap and complex soap/salt thickened polyalphaolefin greases of different viscosity grades can be obtained by the procedure comprising (a) forming a simple soap or complex soap/salt thickener in a quantity of a first polyalphaolefin base oil, said first polyalphaolefin oil having a viscosity which is lower than that of the target base oil viscosity of the finished grease, to form a first thickened mass, (b) adding to the first thickened mass a sufficient quantity of a second polyalphaolefin which has a viscosity higher than that of the target blended base oil viscosity of the finished grease, to produce a grease product containing a mixture of polyalphaolefin oils having the final desired viscosity.

Producing the thickener in a first PAO which has a lower viscosity than that desired of the oil component of the finished grease product and subsequently adding a second PAO which has a viscosity higher than that desired of the oil component of the finished grease product to thereby produce an oil blend having the final desired viscosity, results in a lower amount of thickener being needed to produce a particular grease consistency as compared to the greases made according to a procedure in which the thickener is formed in a PAO base oil having the same viscosity as the finished grease base oil viscosity.

The consistency of a grease is a function of the total concentration of the thickener system, the nature of the molecular associative interactions between the thickener system and the base oil, and the efficiency with which the soap is dispersed in the base oil. In general, a greater thickener content is required in greases containing PAO and typical thickeners relative to the amount required in greases containing naphthenic mineral oils in order to achieve the same consistency target. It is postulated that the higher thickener content is required because of poorer soap dispersion and weaker base oil/thickener system interactions in a PAO based grease. As the total thickener content of a grease is increased, the ability of the grease to flow under the effects of an external shear force begins to decrease. Consequently, PAO based greases which contain high thickener contents are difficult to pump in conventional mechanical grease dispensing systems at low temperatures.

In the present invention the first PAO may be a single PAO or mixture of PAO's, the only proviso being that the first PAO or mixture of PAO's have a viscosity lower than that of the base oil component of the finished grease. Similarly, the second PAO may be a single PAO or mixture of PAO's, again, the only proviso being that the second PAO or mixture of PAO's have a viscosity higher than that of the base oil component of the finished grease. The ratio of the kinematic viscosity at 40° C. (in $mm^2/s$) of the total base oil in the finished grease to the kinematic viscosity at 40° C. (in $mm^2/s$) of the first PAO or PAO mixture shall be greater than 1 but typically less than 100. Preferably, this ratio will be between about 1.1 and 50, more preferably, between about 1.15 and 10, still more preferably between about 1.2 and 5.

If the viscosity of the first PAO or PAO mixture is too low, then the final viscosity target of the finished grease may not be achieved after addition of the maximum allowable amount of the second PAO or PAO mixture as dictated by the target grease consistency as measured, for example, by cone penetration. In the same way, if the amount of low viscosity first PAO is too high then the viscosity of the final grease may not be achieved after addition of maximum allowable amount of the second PAO or PAO mixture again, as dictated by the target grease consistency as measured, for example, by cone penetration. Therefore, it is important to chose a first PAO having a viscosity that is high enough to allow the final base oil viscosity to be achieved, but is still lower than the viscosity of the finished grease base oil viscosity. The actual viscosity of the first PAO and the amount employed, therefore, is left to the practitioner to ascertain on a case-by-case basis with respect to the particular grease of interest, the final viscosity of the total base oil in that grease and final grease consistency target.

PAOs have viscosities in the range of about 1 to 150 cSt at 100° C. Typical PAOs are PAO-2 (vis of about 2 $mm^2/s$ @ 100° C.), PAO 4, (vis of 4 $mm^2/s$ at 100° C.), PAO 6 (vis of 6 $mm^2/s$ at 100° C.), PAO 8 (vis of about 8 $mm^2/s$ at 100° C.) PAO 40 (vis of about 40 $mm^2/s$ at 100° C.) and PAO 100 (vis of about 100 $mm^2/s$ at 100° C.).

Such polyalphaolefins may be produced from linear alpha olefins containing about 8–12 carbon atoms by an oligomerization process which produces dimers, trimers, tetramers, pentamers, etc., of these olefins. In general, the viscosity of the polyalphaolefins increases with the molecular weight of the oligomer, while the mono olefin carbon number, linearity, and position of unsaturation, determine the VI and pour point of the polyalphaolefin oligomer. Generally, the higher the carbon number of the mono olefin, the higher the VI and the higher the pour point of the oligomer. Nonlinear mono olefins are not preferred, since they tend to produce lower VI oligomers. Internal olefin monomers also produce more branched polyolefin structures which exhibit lower VI's and generally lower pour points. A satisfactory combination of pour point viscosity and VI has been obtained by polymerizing $C_{10}$ linear alpha olefins monomers and hydrogenating the resulting polymer.

It is preferred that the low viscosity first PAO oil and the high viscosity second PAO oil be blends of two or more PAO's. For example, the low viscosity PAO oil can be a mixture of PAO 8 and PAO 40 and even a small quantity of PAO 100 can be present so long as the viscosity of the blend is lower than the target viscosity of the total oil component of the finished grease. Similarly, the high viscosity PAO oil can be a mixture of PAO 40 and a larger proportion of PAO 100, with even some small quantity of, e.g., PAO 8 being present, so long as the viscosity of this high viscosity blend is higher than the target viscosity of the total oil component of the finished oil.

In general, the thickener component of a grease is synthesized in a portion of the total oil present in the finished grease. In the present specification this is what is referred to as the first PAO or PAO mixture. Typically this portion of oil represents approximately 40% of the total oil in the finished grease; however, the fraction may range between 20 and 80%. The optimal portion of oil used during the thickener synthesis is dependent on the soap type, the method of manufacture, the viscosity of this first portion of oil, the final grease base oil viscosity, and the target grease consistency. The literature discloses several optimal conditions and those skilled in the art will know the optimal amount of oil which should be used during the thickener preparation of the greases of interest to them.

Within the context of the current invention, it has been discovered that optimal thickener yields will be attained in PAO based greases if the viscosity of the oil used during the thickener preparation is minimized while still maintaining enough viscosity such that the final base oil viscosity of the finished grease can be achieved by adding a second portion of PAO while still meeting the target grease consistency.

The minimum viscosity of the first PAO or PAO mixture will depend on the fraction of total oil used during the thickener synthesis and the viscosity of the second PAO or PAO mixture which is added after thickener formation. By lowering the fraction of total oil used during thickener synthesis and raising the viscosity of second PAO, it is possible to lower the viscosity of first PAO. With the present specification before them, those skilled in the art will be able to arrive at the proper amounts and viscosities of such first PAO or PAO mixture and such second PAO or PAO mixtures as are needed to produce any of the different grades of greases which may be of interest.

Thickeners useful in the present grease formulation include simple lithium, calcium, barium and/or aluminum soaps, preferably simple lithium soaps, complex lithium, calcium barium and/or aluminum soaps/salts, preferably complex lithium soap mixed lithium-calcium soaps, and polyurea.

Polyurea thickeners are well known in the art. They are produced by reacting an amine or mixture of amines and a polyamine or mixture of polyamines with one or more diisocyanates and one or more isocyanates as appropriate. The reaction can be conducted by combining and reacting the group of reactants, taken from the above list in a reaction vessel at a temperature between about 15° C. to 160° C. for from 0.5 to 5 hours. The reaction is usually accomplished in a solvent, which in the case of the present grease production method, is a quantity of a first PAO having a viscosity lower than that of the total base oil to be used in the final grease formulation. Detailed discussion of polyurea thickener production for greases can be found in U.S. Pat. No. 4,929,371.

Simple and complex lithium or calcium soaps for use as thickeners in grease formulations and their method of production are also well known to the grease practitioner. Simple soaps are produced by combining one or more fatty acid(s), hydroxy fatty acid(s), or esters thereof in a suitable solvent usually the grease base oil which in the present invention is a first PAO, or mixture of PAO base oils, of viscosity lower than that of the total base oil to be used in the final grease formulation and reacting the acids or esters with the appropriate base, e.g., LiOH or CaOH. Complex lithium or calcium soap thickeners are prepared by combining one or more fatty acid(s), hydroxy fatty acid(s) or esters thereof with an appropriate complexing agent in a first low viscosity PAO or PAO mixture and reacting the mixture with the appropriate base, e.g., LiOH or CaOH. The complexing agent typically consists of one or more dicarboxylic acids, or esters thereof, or one or more $C_2$ to $C_6$ short chain carboxylic acids, or esters thereof.

The fatty acid or hydroxy fatty acid used in the production of the thickeners employed in the grease of the present invention has 12 to 24 carbon atoms. Thus lithium or calcium salts of $C_{12}$ to $C_{24}$ fatty acids or of 9-, 10- or 12-hydroxy $C_{12}$ to $C_{24}$ fatty acids or the esters thereof are employed.

The lithium complex soaps are prepared by employing both the $C_{12}$–$C_{24}$ fatty acid, hydroxy fatty acid or esters thereof and a $C_2$–$C_{12}$ dicarboxylic acid complexing agent. Suitable acids, therefore, include the hydroxy stearic acids, e.g., 9-hydroxy, 10-hydroxy or 12-hydroxy stearic acid. Unsaturated fatty or hydroxy fatty acids or esters thereof such as recinolic acid which is an unsaturated form of 12-hydroxy stearic and having a double bond in the 9–10 position, as well as the ester of each acid, can also be used. The $C_2$–$C^{12}$ dicarboxylic acids employed will be one or more straight or branched chain $C_2$–$C_{12}$ dicarboxylic acids, preferably $C_4$–$C_{12}$, more preferably $C_6$ to $C_{10}$ dicarboxylic acids or the mono- or di- esters thereof. Suitable examples include oxalic, malonic, succinic, glutaric, adipic, suberic, pimelic, azelaic, dodecanedioic and sebacic acids and the mono- or di- esters thereof. Adipic, sebacic, azelaic acids and mixtures thereof, preferably sebacic and azelaic acids and mixture thereof are employed as the dicarboxylic acids used in the production of the complex lithium soap grease bases.

The calcium complex soaps are prepared by employing the $C_{12}$ to $C_{24}$ fatty acid, hydroxy fatty or ester or glyceride thereof and a $C_2$ to $C_6$ short chain carboxylic acid complexing agent. Suitable acids include stearic acids, e.g., 9-hydroxy, 10-hydroxy or 12-hydroxy stearic acid. The short chain carboxylic acid can be straight chain or branched, preferably $C_2$ to $C_6$, and more preferably $C_2$, $C_3$ or $C_4$. Examples of short chain carboxylic acids include acetic acid, propanoic acid, butanoic acid, etc. Acetic acid is the preferred complexing acid in the production of calcium complex greases. Acetic acid can be added to the grease formulation in the form of the free acid and then neutralized with CaOH along with the fatty acid, fatty acid ester or fatty acid glyceride; or alternatively, calcium acetate can be added to the grease directly.

Neutralization of the simple acid type soap (simple soap) or different acid-type acid mixture (complex soap) with the base is usually conducted at a temperature in the range of about 180° to 220° F. When the soap has thickened to a heavy consistency the temperature is raised to about 290°–310° F. to ensure elimination of water. Subsequent heating to a high temperature of about 380°–420° F. followed by addition of the second PAO or PAO mixture of higher viscosity than that of the total base oil used in the final grease product and cooling to about 220° F. can also be practiced to produce a mixed oil having the target final product oil viscosity.

While it is expected that the skilled practitioner of grease production will be familiar with the technique used to produce complex lithium or calcium greases, various of such production methods are presented in detail in U.S. Pat. No. 3,681,242, U.S. Pat. No. 3,791,973, U.S. Pat. No. 3,929,651, U.S. Pat. No. 5,236,607, U.S. Pat. No. 4,582,619, U.S. Pat. No. 4,435,299, U.S. Pat. No. 4,787,992. Mixed lithium-calcium soap thickened greases are described in U.S. Pat. No. 5,236,607, U.S. Pat. No. 5,472,626. The particular techniques used to produce the simple or complex lithium or calcium soaps or lithium-calcium soaps are not believed to be critical in the present invention and do not form part of the present invention. The above is offered solely as illustration and not limitation.

In the present invention the preferred thickener, regardless of the technique used for its production, is complex lithium soap.

The grease formulation of the present invention contains anywhere from 1 to 30 wt % thickener, preferably 5 to 15 wt % thickener, based on the finished formulation, but as previously indicated, the amount of thickener present in the PAO grease made according to the present invention will be lower than the amount present in a comparable PAO grease made according to a process in which the thickener component is prepared or synthesized in a PAO or PAO mixture having a viscosity which is the same as, or greater than, the viscosity of the base oil in the finished grease.

A preferred complex lithium grease base is disclosed and cleared in U.S. Pat. No. 3,929,651 which also teaches a detailed procedure for its production. The teachings of that patent are incorporated herein by reference. Broadly that complex lithium grease base comprises a major amount of a base oil, a minor amount of a complex lithium soap thickener and a minor quantity of a lithium salt of a $C_3$–$C_{14}$ hydroxy carboxylic acid where in the OH group is attached to a carbon atom that is not more than 6 carbon atoms removed from the carbon of the carboxyl group.

The complex lithium soap is any of the conventional complex lithium soaps of the literature and typically comprises a combination of a dilithium salt of a $C_2$–$C_{12}$ dicarboxylic acid or the mono- or di- ester of such acids and a lithium salt of a $C_{12}$–$C_{24}$ fatty acid or of a 9-, 10- or 12-hydroxy $C_{12}$–$C_{24}$ fatty acid or the ester of such acid. These materials have been discussed in detail above. In addition, the grease also contains an additional lithium salt component, the lithium salt of a hydroxy carboxylic acid (s) or ester(s) thereof having an OH group attached to a carbon atom that is not more than 6 carbons removed from the carbon of the carboxyl group. This acid has from 3 to 14 carbon atoms and can be either an aliphatic acid such as lactic acid, 6-hydroxy-decanoic acid, 3-hydroxybutanoic acid, 4-hydroxybutanoic acid, 6-hydroxy-alpha-hydroxystearic acid, etc., or an aromatic acid such as para-hydroxybenzoic acid, salicylic acid, 2-hydroxy-4-hexylbenzoic acid, meta-hydroxy-benzoic acid, 2,5-dihydroxybenzoic acid (gentisic acid); 2,6-dihydroxybenzoic acid (gamma resorcyclic acid); 2-hydroxy-4-methoxybenzoic acid, etc., or a hydroxyaromatic aliphatic acid such as 2-(ortho hydroxphenyl)-,2-(meta hydroxyphenyl)-, or 2-(parahydroxyphenyl)-ethanoic acid. A cycloaliphatic hydroxy acid such as hydroxycyclopentyl carboxylic acid or hydroxynaphthenic acid could also be used. Particularly useful hydroxy acids (or the esters thereof) are 2-hydroxy-4-methoxybenzoic acid, salicylic acid, and parahydroxybenzoic acid. Instead of using the free hydroxy acid of the latter type when preparing the grease, one can use a lower alcohol ester, e.g., the methyl, ethyl, or propyl, isopropyl, or secbutyl ester of the acid, e.g., methyl salicylate. The ester of the hydroxy carboxylic acid is hydrolyzed with aqueous lithium hydroxide to give the lithium salt. The monolithium salt or the dilithium salt of the $C_3$–$C_{14}$ hydroxy acid or ester thereof can be used, but the dilithium salt is preferred.

As taught in U.S. Pat. No. 3,929,651, these three component lithium salt thickeners can be formed in a number of different ways. One convenient way when the $C_3$–$C_{14}$ hydroxy carboxylic acid is salicylic acid is to co-neutralize the $C_{12}$–$C_{24}$ fatty acid or 9-, 10-, or 12- hydroxy $C_{12}$–$C_{24}$ fatty acid and the dicarboxylic acid in at least a portion of the oil with lithium hydroxide. In the present invention this first portion of oil is a first PAO or PAO mixture having a viscosity lower than that of the total oil component of the finished grease product. This neutralization will take place at a temperature in the range of about 180° F. to 220° F. When the soap stock has thickened to a heavy consistency, the temperature is raised to about 260° F. to 300° F., to bring about dehydration. The soap stock is then cooled to about 190° F. to 210° F., and the additional acid or ester of the $C_3$–$C_{14}$ hydroxy carboxylic acid, e.g., methyl salicylate is added; then, additional lithium hydroxide is added gradually to convert the acid or ester, e.g., salicylate, to the dilithium acid or ester e.g., salicylate, salt. Reaction is conducted at about 220° F. to 240° F., preferably with agitation so as to facilitate the reaction. In this reaction, the alcohol is evolved, and dilithium acid or ester, e.g., salicylate, salt forms.

Dehydration is then completed at 300° F. to 320° F., after which the grease is heated at 380°–390° F. for 15 minutes to improve its yield and is then cooled while additional oil is added to obtain the desired consistency. In the present invention this additional oil is a quantity of a second PAO or PAO mixture of viscosity higher than that of the total oil component of the finished grease, the amount of such second PAO added being (1) sufficient to raise the viscosity of the total oil component to the level desired in the finished grease and (2) sufficient to soften the base grease concentrate to the desired consistency of the finished grease. The consistency of the finished grease is measured by the ASTM D217 cone penetration test or other suitable methods and identification of the particular target consistency is left to the practitioner formulating the specific grease of interest to him or her. Alternatively, the additional oil can be added to the soap concentrate prior to the in situ formation of the dilithium acid or ester, e.g., salicylate, salt.

An alternative method is to co-neutralize all three types of acid used in making the grease, or to saponify a lower ester of the hydroxy $C_3$–$C_{14}$ acid, e.g., methyl salicylate, simultaneously with the neutralization of the hydroxy fatty acid of the first type, e.g., hydroxystearic acid and the dicarboxylic acid. Still another alternative is to co-neutralize the hydroxy fatty acid and the ester of the hydroxy $C_3$–$C_{14}$ acid followed by neutralization of the dicarboxylic acid.

The greases contain, based on the finished grease mass, from about 2 to about 35 wt % and preferably about 10 to about 25 wt % of all three lithium salt components. The additional lithium salt of the $C_3$–$C_{14}$ hydroxycarboxylic acid (e.g., dilithium salicylate) is present in the grease in an amount in the range 0.05 to 10 wt % of the finished grease. The proportion of the lithium soap of $C_{12}$–$C_{24}$ fatty acid or 9-, 10- or 12- hydroxy $C_{12}$–$C_{24}$ fatty acid to the lithium soap of the dicarboxylic acid can be in the range of 0.5 to 15 parts by weight of the former to one part by weight of the latter, preferably in the range of 1.5 to 5 parts by weight of the soap of the $C_{12}$–$C_{24}$ fatty acid or 9-, 10- or 12- hydroxy $C_{12}$–$C_{24}$ fatty acid to one part by weight of the soap of the dicarboxylic acid. The proportion of the $C_3$–$C_{14}$ hydroxy carboxylic acid to the dicarboxylic acid will be from about 0.025 to 2.5 parts by weight of the hydroxy carboxylic acid to one part by weight of the dicarboxylic acid, preferably about 0.125 to 1.25 parts by weight of the hydroxy carboxylic acid to one part by weight of the dicarboxylic acid.

While the thickener yield of a particular grease is dependent on the particular kettle or vessel used to manufacture the grease and the optimum conditions of operation for that particular kettle (i.e., dehydration rate and time, water content and top temperature hold time), the present invention functions independently of such optimization of the individual and unique set of operating conditions for any particular kettle. The present invention will result in better thickener yields, relative to the case in which the base oil viscosity in the cooking charge (i.e., the base in which thickener is prepared) and that of the target base oil blend are equal, for a given set of operating parameters and conditions. Thus, under conditions where all other process steps, equipment or variables are equal or held constant, the method of the present invention will result in unexpectedly improved thickener/grease yields (i.e., grease meeting viscosity and grease consisting targets but at a lower thickener content).

A preferred complex lithium grease is described and claimed in copending application U.S. Ser. No. 712,066 filed Sep. 11, 1996, in the name of David L. Andrew. In that application the grease comprises the three component lithium salt thickener described in U.S. Pat. No. 3,929,651 and additionally contains a thiadiazole which has been found to enhance the oxidation resistance of such a grease.

The thiadiazol type materials used in that formulation are the general formula:

$$R_1—(S)_x—Q—(S)_y—R_2 \quad (1)$$

wherein Q is a 1,3,4-thiadiazole, 1,2,4-thiadiazole, 1,2,3-thiadiazole or a 1,2,5-thiadiazole heterocycle, "x" and "y" may be the same or different and are integers from 1 to 5 and $R_1$ and $R_2$ are the same or different and are H or $C_1$–$C_{50}$ hydrocarbyl, or (2)

$$R_1—(S)_x—Q_1—(S)_z—Q_2—(S)_y—R_2 \quad (2)$$

wherein $Q_1$ and $Q_2$ are the same or different and are 1,3,4-thiadiazole, 1,2,4-thiadiazole, 1,2,3-thiadiazole or 1,2,5-thiadiazole heterocycles, "x", "y", and "z" may be the same or different and are integers of from 1 to 5, and $R_1$ and $R_2$ are the same or different and are H or $C_1$–$C_{50}$ hydrocarbyl. The preferred thiadiazole has the structure 2 where x=1, y=1 and z=2, $R_1$=hydrogen, $R_2$=hydrogen and $Q_1$=$Q_2$ and is 1,3,4-thiadiazole. The preferred thiadiazole is available from R. T. Vanderbilt Company, Inc., under the trade name Vanlube 829. Such thiadiazole additives can be present in the three component lithium soap/salt greases described above in an amount in the range 0.05 to 5.0 wt % based on the finished grease.

In copending application Attorney Docket Number LAW498, U.S. Ser. No. 08/815,018, filed Mar. 14, 1997, in the name of David L. Andrew and Brian L. Slack, it is disclosed that simple and complex greases can have this corrosion resistance capacity increased by addition of a 0.01 to 10 wt %, preferably 0.05 to 5 wt % more preferably 0.2 to 1.5 wt % of a hydrocarbyl diamine of the formula:

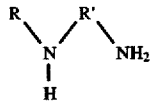

where R and R' are the same or different and are $C_1$–$C_{30}$ straight a branch chain alkyl, alkenyl, alkynyl, aryl substituted aliphatic chains, the aliphatic chains being attached to the nitrogen in the molecule. Preferably R is a $C_{12}$–$C_{18}$ hydrocarbyl moiety, preferably alkyl or alkenyl moiety, and $R_1$ is a $C_2$–$C_6$ hydrocarbyl, preferably alkyl moiety. Preferred hydrocarbyl diamines include those wherein R is a dodecylradical and R' is a 1,3 propyl diradical (commercially available from Akzo Chemie under the trade name DUOMEEN C); or wherein R=oleyl radical, R'=1,3 propyl diradical (known as DUOMEEN O) or wherein R=tallow radicals, R'=1,3 propyl diradical (known as DUOMEEN T).

Further the grease of the present invention can contain any of the typical grease additives including conventional antioxidants, extreme pressure agents, anti wear additives tackiness agents, dyes, anti rust additives, etc. Such typical additives and their functions are described in "Modern Lubricating Greases" by C. J. Boner, Scientific Publication (G.B.) Ltd., 1976.

Examples of antioxidants include the phenolic and aminic type antioxidants and mixture thereof.

The amine type anti-oxidants include diarylamines and thiodiaryl amines. Suitable diarylamines include diphenyl amine; phenyl-α-naphthyl-amine; phenyl-β-naphthylamine; α-α-di-naphthylamine; β,β-dinaphthylamine; or α,β-dinaphthylamine. Also suitable antioxidants are diarylamines wherein one or both of the aryl groups are alkylated, e.g., with linear or branched alkyl groups containing 1 to 12 carbon atoms, such as the diethyl diphenylamines; dioctyldiphenyl amines, methyl phenyl-α-naphthylamines; phenyl-β(butyl-naphthyl) amine; di(4-methyl phenyl) amine or phenyl (3-propyl phenyl) amine octyl-butyl-diphenylamine, dioctyldiphenyl amine, octyl-, nonyl-diphenyl amine, dinonyl di phenyl amine and mixtures thereof.

Suitable thiodiarylamines include phenothiazine, the alkylated phenothiazines, phenyl thio-α-naphthyl amine; phenyl thio-β-naphthylamine; α-α-thio dinaphthylamine; β-β-thio dinaphthylamine; phenyl thio-α (methyl naphthyl) amine; thio-di (ethyl phenyl) amine; (butyl phenyl) thio phenyl amine.

Other suitable antioxidants include 2-triazines of the formula

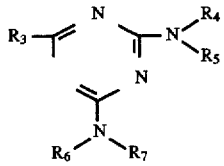

I where $R_4$, $R_5$, $R_6$, $R_7$, are hydrogen, $C_1$ to $C_{20}$ hydrocarbyl or pyridyl, and $R_3$ is $C_1$ to $C_8$ hydrocarbyl, $C_1$ to $C_{20}$ hydrocarbylamine, pyridyl or pyridylamine. If desired mixtures of antioxidants may be present in the lubricant composition of the invention.

Phenolic type anti-oxidants include 2,6-di-t-butyl phenol, 2,6-di-t-butyl alkylated phenol where the alkyl substituent is hydrocarbyl and contains between 1 and 20 carbon atoms, such as 2,6-di-t-butyl-4-methyl phenol, 2,6-di-t-butyl-4-ethyl phenol, etc., or 2,6-di-t-butyl-4-alkoxy phenol where the alkoxy substituent contains between 1 and 20 carbons such as 2,6-di-t-butyl-4-methoxy-phenol; materials of the formula

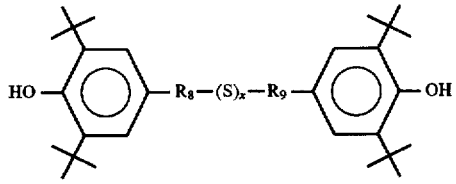

II where X is zero to 5, $R_8$ and $R_9$ are the same or different and are $C_1$–$C_{20}$ hydrocarbyl which may contain oxygen or sulfur or be substituted with oxygen or sulfur containing groups; and materials of the formula

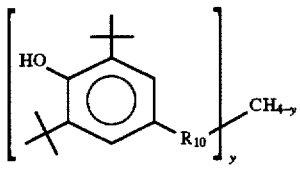

III where y is 1 to 4 and $R_{10}$ is a $C_1$ to $C_{20}$ hydrocarbyl which may contain oxygen or sulfur or be substituted with oxygen or sulfur containing groups, and mixtures of such phenolic type antioxidants.

If present at all the antioxidants, preferably amine type and/or phenolic antioxidants are present in the grease in an amount up to 5 wt % of the finished grease.

Among the preferred extreme pressure and antiwear additives are lead naphthenate, lead dialkyldithiocarbamate, zinc dialkyldithiocarbamates, zinc dialkyldithiophosphates, sulfurized alkenes (e.g., sulfurized isobutylene), antimony dialkyldithiophosphates, 4,4'-methylene bis (dialkyldithiocarbamate), sulfurized fats or fatty acids, amine phosphate salts, phosphites and phosphite esters, etc.

Among the preferred anti-rust additives are various sulphonates based on sodium, barium, calcium, etc. Amine phosphates, sodium nitrite, alkylated ammonium nitrite salts, compounds containing imidazoline functionality, or zinc naphthenate can also be used as rust inhibitors.

To this additive package may be added other additives required for the specific end use, such as seal swell agents, tackiness additives, dyes, etc.

The present invention is demonstrated in the following not limiting examples and comparative examples.

EXPERIMENTAL

Laboratory experiments have demonstrated that improved thickener yields may be achieved in PAO based greases if initial soap formation occurs in a low viscosity PAO or mixture instead of a high viscosity PAO or mixture. A heavier PAO (e.g., PAO 100) may be used to oil-back base greases which are prepared in low viscosity PAO's after the thickener formation stage is completed. By adding the higher viscosity PAO after the soap formation stage, it is possible to produce a finished grease containing a base oil viscosity much higher than that used during soap formation. Using a heavy PAO during the oil-back stage does not negate the yield credits obtained by preparing the thickener system in a low viscosity PAO.

Table 1 contains a summary of five synthetic greases which had their thickener systems prepared in PAO base oils of differing viscosities. All of the greases listed in the table were oiled-back with an appropriate PAO such that the viscosity of the base oil blend in the finished grease was representative of an ISO 460 grade. Laboratory Batches I, II and III were all prepared in the same laboratory grease kettle using the same processing conditions except for the viscosity of the PAO used during thickener formation. The comparative example listed as Lab Batch III had its thickener system prepared in a PAO base oil with viscosity equal to that present in the finished grease (i.e., 460 $mm^2/s$ @ 40° C.). The PAO composition used to prepare the thickener system of Lab Batch III was the same as the PAO composition of the second PAO fraction added to the grease after thickener formation (i.e., the oil-back fraction). The PAO base oils used to prepare the thickener systems of Lab Batches I and II had viscosities considerably less than the viscosity of the PAO in the finished grease. The viscosity of the PAO added to Lab Batches I and II after thickener formation was greater than the viscosity of the PAO oil in the finished grease.

The data in Table 1 indicate that a greater amount of 12-hydroxystearic acid was required to thicken the greases in which soap formation was performed in the higher viscosity PAO. Examination of the 12-hydroxystearic acid contents of lab Batches II and III revealed that 18% more 12-OH stearic acid thickener was required to thicken Batch III relative to Batch II. The thickener formation in Batch III was carried out in a PAO base oil of the same viscosity as the finished grease, whereas the thickener formation of Batch II was carried out in a PAO which had a viscosity considerably less than the viscosity of the base oil in the finished grease. Lab Batch I also required less thickener than Lab Batch III to achieve a similar consistency target. The thickener preparation for Lab Batch I was carried out in a PAO with a viscosity slightly less than the viscosity of the PAO mixture in the finished grease. Comparison of all three Lab Batch samples (i.e., I, II and III) demonstrates that improved thickener yields are obtained when the viscosity of the PAO present during thickener formation is lowered relative to the viscosity of the PAO in the finished grease. The difference between the 12-hydroxy stearic acid contents of Lab Batch I and II indicates that decreasing the viscosity of the PAO present during thickener formation as much as possible while still maintaining enough viscosity to achieve finished grease viscosity and consistency targets, results in an optimum thickener yield. Therefore, the laboratory batch data in Table 1 indicate that forming the soap component in a base oil of lower viscosity results in improved grease thickening efficiency.

The data obtained from the two large scale batches summarized in Table 1 also demonstrate that improved thickener yields can be obtained if the initial soap formation procedure is performed in a lower viscosity base oil. For example, approximately 14% less 12-hydroxy-stearic acid soap was required to thicken large scale test Batch A relative to a commercial Batch B. Large scale Batch A was cooked in a PAO base oil with a much lower viscosity relative to the base oil used to cook commercial Batch B. The data obtained from the commercial test batch demonstrate the viability of the new grease manufacturing method.

TABLE 1

| | Comparative Example 1 | Comparative Example 2 | Examples | | |
|---|---|---|---|---|---|
| | Commercial Batch | Lab Batch III | Lab Batch I | Large Scale Batch A | Lab Batch II |
| Base Oil Ratio in Kettle Charge Used During Soap Formation | wt % ratio | wt % ratio | wt % ratio | wt % ratio | wt % ratio |
| PAO 100 | | 12 | | 52 | 52 |
| PAO 40 | 100 | 88 | 100 | | |
| PAO 8 | | | | 48 | 48 |
| Viscosity of Base Oil Blend Used During Soap Formation | | | | | |
| cSt @ 40° C. | 460* | 460 | 400 | 260 | 260 |
| Composition of Finished Grease | wt % | wt % | wt % | wt % | wt % |
| PAO 100 | | 8.77 | 9.02 | 52.35 | 53.60 |
| PAO 40 | 70.11 | 64.30 | 66.20 | | |
| PAO 8 | | | | 25.08 | 24.08 |
| Styrene Isoprene Polymer (Shellvis 40) | 0.76 | | | | |
| 12-OH Stearic Acid | 13.65 | 14.18 | 13.18 | 11.89 | 12.11 |
| Azelaic Acid | 3.41 | 3.28 | 2.93 | 2.38 | 2.42 |
| Lithium Hydroxide | 3.50 | 3.68 | 3.29 | 2.82 | 2.87 |
| Total Additive Concentration | 8.57 | 5.19 | 5.38 | 5.48 | 4.92 |
| Properties of Finished Grease | | | | | |
| Grease consistency as measured by 60 stroke cone penetration (mm/10) | 290 | 309 | 326 | 296 | 306 |
| ISO Viscosity Grade of PAO blend used in finished grease | 460 | 460 | 460 | 460 | 460 |
| Viscometrics of PAO blend used in finished grease: | | | | | |
| cSt @ 40° C. | | 463.4 | 463.4 | | 461.5 |
| cSt @ 100° C. | | 45.1 | 45.1 | | 47.5 |

TABLE 1-continued

| | Comparative Example 1 | Comparative Example 2 | Examples | | |
|---|---|---|---|---|---|
| | Commercial Batch | Lab Batch III | Lab Batch I | Large Scale Batch A | Lab Batch II |
| VI | | 153 | 53 | | 161 |
| Apparent Viscosity of the finished grease at a shear rate of 20 $sec^{-1}$: | | | | | |
| Poise @ −10° C. | 2400 | 2100 | 1500 | 1250 | 1250 |
| Poise @ −20° C. | 5400 | 5000 | 3200 | 2700 | 2500 |

*Includes contribution from styrene-isoprene copolymer VI improver.
The base oil viscosity without the copolymer VI improver was 400 $mm^2/s$ at 40° C.

The benefits resulting from lower thickener contents in PAO based greases are exemplified by the pumpability characteristics of these greases. The pumpability characteristics can be quantified indirectly by measuring the apparent viscosity of the grease at various shear rates. A high apparent viscosity at a particular shear rate and temperature corresponds to poor pumpability characteristics. Table 1 contains apparent viscosity data obtained at a shear rate of 20 reciprocal seconds which approximately corresponds to the shear rate in a conventional hand grease gun. The apparent viscosity of Laboratory Batch III at a shear rate of 20 $sec^{-1}$ and a temperature of −10° C. is 2100 Poise. This apparent viscosity is significantly greater than the apparent viscosity of Lab Batch II (i.e., 1250 P) which was prepared according to the new process and had a thickener content of only 12.11 wt %. At a shear rate of 20 $sec^{-1}$ and a temperature of −10° C., the apparent viscosity of Lab Batch I was 1500 Poise. The apparent viscosity data obtained at −20° C. (see Table 1) also demonstrate that the pumpability characteristics of Lab Batch III are poorer than the pumpability characteristics of Lab Batches I and II. Therefore, review of the apparent viscosity and thickener concentration data for Laboratory Batch III and Lab Batches I and II clearly demonstrate the fact that grease pumpability is negatively impacted by high thickener contents (i.e., poor thickener yields) for a specified finished grease consistency and base oil viscosity. The new process disclosed herein demonstrates how thickener yields can be improved by manipulating the viscosity of the PAO base oil which is present in the cooking charge during synthesis of the thickener system. In summary, the data show that the new manufacturing method can be used to prepare greases with enhanced pumpability characteristics.

Table 2 contains data for two PAO based greases which contain a finished grease base oil viscosity representative of an ISO 220 grade. The thickener system of Lab Batch V was prepared in a PAO base oil which had a much lower viscosity than that used to prepare the thickener system of Lab Batch IV. The 60 stroke penetration test data in Table 2 indicate that Lab Batch IV is a softer grease than Lab Batch V despite the fact that the concentration of the 12-hydroxy stearic acid soap thickener in Lab Batch IV formulation is higher. This indicates that the thickening efficiency of the thickener system present in Lab Batch V (lower soap concentration but harder grease) is greater than that in Lab Batch IV (higher soap concentration but softer grease). This increased thickening efficiency is attributed to the improvements made by manufacturing the thickener system of Lab Batch V in a lower viscosity PAO blend. Therefore, the data in Table 2 support the conclusions derived from the data obtained for the ISO VG 460 PAO based greases listed in Table 1.

TABLE 2

| | Lab Batch IV | Lab Batch V |
|---|---|---|
| Base Oil Ratio in Kettle Charge Used During Soap Formation | wt % ratio | wt % ratio |
| PAO 100 | | 14 |
| PAO 40 | 64 | |
| PAO 8 | 36 | 86 |
| Viscosity of Base Oil Blend Used During Soap Formation | | |
| cSt @ 40° C. | 170 | 70 |
| Composition of Finished Grease | wt % | wt % |
| PAO 100 | | 36.44 |
| PAO 40 | 57.82 | |
| PAO 8 | 19.27 | 41.10 |
| 12-OH Stearic Acid | 12.58 | 12.29 |
| Azelaic Acid | 3.15 | 3.07 |
| Lithium Hydroxide | 3.28 | 3.20 |
| Total Additive Concentration | 3.90 | 3.90 |
| Properties of Finished Grease | | |
| NLGI consistency grade | 1.5 | 2 |
| Grease consistency as measured by 60 stroke cone penetration (mm/10) | 305 | 277 |
| ISO Viscosity Grade of PAO blend used in finished grease | 220 | 220 |
| Viscometrics of PAO blend used in finished grease: | | |
| cSt @ 40° C. | 221.1 | 226.8 |
| cSt @ 100° C. | 25.13 | 27.23 |
| VI | 143 | 154 |

What is claimed is:

1. A method for improving the yields of polyalphaolefin base oil greases of different grease viscosity grades, wherein the grease viscosity grade is determined by the viscosity of the final base oil in the grease comprising (a) forming a thickener in a quantity of a first polyalphaolefin oil, said first polyalphaolefin oil having a viscosity which is lower than the final base oil viscosity of the grease, to form a first thickened mass, (b) adding to the first thickened mass a sufficient quantity of a second polyalphaolefin oil which has a viscosity which is higher than that of the final base oil viscosity of the grease to thereby produce a finished grease product containing a final mixture of polyalphaolefin oils having the desired viscosity of the final, total base oil.

2. The method of claim 1 wherein the thickener is selected from the group consisting of simple lithium, calcium, barium, or aluminum soap and mixtures thereof, complex lithium, calcium, barium or aluminum soap and mixtures thereof, mixed lithium-calcium soaps, and polyurea.

3. The method of claim 1 wherein the thickener is a complex lithium soap.

4. The method of claim 1 wherein the first polyalphaolefin in which the thickener is from comprises about 20 to 80% of the total oil content of the grease.

5. The method of claim 1 wherein the first polyalphaolefin base oil is a single polyalphaolefin oil or a mixture of polyalphaolefin oils.

6. The method of claim 1 wherein the second polyalphaolefin oil is a single polyalphaolefin oil or a mixture of polyalphaolefin oils.

7. The method of claims 1, 2, 3, 4, 5 or 6 wherein the ratio of the kinematic viscosity at 40° C., in $mm^2s$ of the final base oil in the finished grease to the kinematic viscosity at 40° C. (in $mm^2/s$) of the first polyalphaolefin oil is greater than 1 but less than 100.

8. The method of claim 7 wherein the ratio is between 1.1 and 50.

9. The method of claim 7 wherein the ratio is between 1.15 and 10.

10. The method of claim 7 wherein the ratio is between 1.2 and 5.

* * * * *